United States Patent [19]

Laumen

[11] Patent Number: 4,748,826

[45] Date of Patent: Jun. 7, 1988

[54] REFRIGERATING OR HEAT PUMP AND JET PUMP FOR USE THEREIN

[75] Inventor: Michael Laumen, Krefeld, Fed. Rep. of Germany

[73] Assignee: Michael Laumen Thermotechnik Ohg., Krefeld, Fed. Rep. of Germany

[21] Appl. No.: 867,367

[22] PCT Filed: Aug. 23, 1985

[86] PCT No.: PCT/DE85/00290

§ 371 Date: Jun. 24, 1986

§ 102(e) Date: Jun. 24, 1986

[87] PCT Pub. No.: WO86/01582

PCT Pub. Date: Mar. 13, 1986

[30] Foreign Application Priority Data

Aug. 24, 1984 [DE] Fed. Rep. of Germany ..... 3431240

[51] Int. Cl.[4] ..... F25B 19/00

[52] U.S. Cl. ..... 62/268; 62/500; 62/238.5; 62/513; 417/174

[58] Field of Search ..... 237/2 B; 62/500, 476, 62/268, 226, 501, 513, 191, 238.5; 417/163–170, 174, 196, 176, 177, 179, 151

[56] References Cited

U.S. PATENT DOCUMENTS

| | | | |
|---|---|---|---|
| 1,733,400 | 10/1929 | Carrey | 62/115 X |
| 1,866,526 | 7/1932 | Davenport | 62/115 X |
| 1,972,704 | 9/1934 | Crosthwait | 62/115 X |
| 2,044,811 | 6/1936 | Randel | 62/115 X |
| 2,064,609 | 12/1936 | Humbtt | 62/115 X |
| 2,206,428 | 7/1940 | Reavis . | |
| 2,763,998 | 9/1956 | Tulleners | 417/163 X |
| 2,931,190 | 4/1960 | Dubitzky | 62/115 X |
| 3,196,634 | 7/1965 | Rich . | |
| 3,199,310 | 8/1965 | Schlichtig . | |
| 3,680,327 | 8/1972 | Stein . | |

FOREIGN PATENT DOCUMENTS

| | | | |
|---|---|---|---|
| 0043566 | 1/1982 | European Pat. Off. . | |
| 513790 | 12/1930 | Fed. Rep. of Germany . | |
| 633200 | 7/1936 | Fed. Rep. of Germany | 417/163 |
| 822396 | 11/1951 | Fed. Rep. of Germany | 417/163 |
| 1501591 | 10/1969 | Fed. Rep. of Germany | 417/163 |
| 2752997 | 5/1979 | Fed. Rep. of Germany . | |
| 2937438 | 9/1979 | Fed. Rep. of Germany . | |
| 2834075 | 2/1980 | Fed. Rep. of Germany . | |
| 3011375 | 10/1981 | Fed. Rep. of Germany . | |
| 3049647 | 2/1982 | Fed. Rep. of Germany . | |
| 3028153 | 3/1982 | Fed. Rep. of Germany . | |
| 2754783 | 5/1983 | Fed. Rep. of Germany . | |
| 361049 | 12/1905 | France . | |
| 1202441 | 1/1960 | France . | |
| 2863 | 12/1980 | PCT Int'l Appl. | 417/163 |

*Primary Examiner*—Henry A. Bennet

*Attorney, Agent, or Firm*—Cushman, Darby & Cushman

[57] ABSTRACT

A refrigerator or heat pump with a jet pump (1) as the compressor, in which the evaporator (2) of the heat-pump or refrigerator circuit is incorporated in the jet pump (1). In the simplest case, this is achieved by the presence, in the inlet line, of a partition (18, 39, 40, 41) made of porous material such as, for example, sintered metal, which firstly exercises a throttling action between the condenser pressure and the evaporation pressure and secondly on whose large internal surface the evaporation of the working medium takes place at the same time. The supply of the evaporation heat is obtained by the fact that only one part of the liquid working medium fed from the condenser (3) is evaporated, and on the other hand heat can be supplied from outside via heat-exchangers (21, 27). Heat-pump or refrigerator circuits with a jet pump of this type (1, 24, 30) can also be designed with several stages, so that an internal heat exchange can be effected in a number of ways. The jet compressor (1) used may also include jet pumps with a multiplicity of nozzles (31, 32, 33, 34) located behind one another, which form a multiplicity of jet pump stages connected in series.

16 Claims, 10 Drawing Sheets

REFRIGERATING OR HEAT PUMP AND JET PUMP FOR USE THEREIN

The invention relates to a refrigerating system or a heat pump in accordance with the prior art part of claim 1, and to a jet pump which is particularly suitable for use in such system.

Such refrigerating systems which have no compressor and in which compression is effected in a jet pump have been described in numerous publications. An example used in conjunction with a refrigerating plant for use in chemical process technology has been described, for instance, in the periodical "Wärmepumpenp", 1978, 161, 168, and constitutes a basis for the present invention.

In that system, water vapor under low pressure is delivered by an evaporative condenser and is used as motive vapor in a jet pump consisting of a vapor jet compressor to suck water vapor as entrainable vapor from a trickling-flow evaporator. The mixture of motive vapor and entrained vapor is then condensed in a condenser and is supplied to throttling means consisting of a standpipe, from which that portion of the vapor which is intended to form motive vapor is pumped back to the evaporative condenser and that portion which is intended to form entrainable vapor is returned vapor is returned to the evaporator through a heat exchanger, in which heat is supplied to the condensate. The condensate is only partly evaporated in the evaporator and the non-evaporated portion of the condensate is recycled to the circulatory system. In the evaporator the energy required for the evaporation is derived from the higher temperature at which the condensate is supplied so that the non-evaporated condensate is at a lower temperature as it leaves the evaporator.

That known refrigerating system just as other refrigerating systems which comprise a jet pump has the disadvantage that the evaporator consisting of a separate unit which is disposed outside the jet pump but closely adjacent thereto constitutes expensive equipment and sometimes requires a very large installation space so that it adds appreciably to the complication and cost of the refrigerating system. Besides, the generation of vapor outside the jet pump requires low-pressure vapor of low density to be transported in correspondingly large-volume conduit elements, which also add to the costs and increase the installation space.

In all known refrigerating systems and heat pumps provided with jet pumps as a compressor the ratio of the rate of entrained vapor to the rate of motive vapor, i.e., the volumetric efficiency, is relatively low so that such known refrigerating systems or heat pumps cannot be used economically unless motive vapor is available at low cost.

A further disadvantage resides in that the jet pumps of such refrigerating systems or heat pumps will operate optimally only close to the design point of the jet pump and will respond to changes of the pressure and temperature conditions by a drastic reduction of the volumetric efficiency.

For this reason it is an object of the present invention to provide a refrigerating system or heat pump which is of the kind described in the prior art parts of claims 1 and 7 and in which the jet compressor has a substantially higher volumetric efficiency.

That object is accomplished by the characterizing features of claim 1.

As a result, the evaporator consists in the simplest case of a wall of porous material, such as sintered metal, so that the action of the motive fluid to suck the entrainable vapor will result in a pronounced pressure drop depending on the thickness of said wall. The porous wall acts as throttling means. On the downstream side of the wall the suction action of the motive fluid results in a pressure depending on the throttling action of the wall. At the prevailing temperature of the condensate that pressure will always be lower than the evaporation pressure. A further decrease of that pressure is opposed by the evaporation of the condensate so that a dynamic equilibrium is obtained between the resulting pressure and the rate at which the condensate is evaporated as a further pressure drop would result in a higher rate of evaporation. It is thus ensured that the pressure drop which proceeds continuously through the thickness of the wall results in an evaporation of condensate in the interior of the porous material so that the large internal surface of the porous material, preferably consisting of sintered material, is effective as an evaporating surface. The heat required for the evaporation is either extracted from non-evaporating condensate, which is then discharged at a lower temperature, or is supplied by a heat source, which is heat-conductively joined to the wall and supplies energy for the evaporation. In that case a complete evaporation can be effected. Owing to the extraction of heat for evaporation, the temperature of the porous material of the wall decreases so that a larger temperature difference results relative to a heat source and to inflowing condensate and in a given refrigerating system that temperature difference may equal the largest possible temperature difference so that the transfer of heat for evaporation from the heat source or the condensate to the porous material will be promoted. If the wall consists of an effectively heat-conductive material, such as metal, the temperature will be substantially uniform throughout the thickness of the wall so that even when the evaporation is effected only adjacent to the downstream side a large temperature drop will be obtained on the condensate-receiving side of the wall and at any surfaces through which heat enters the wall.

The vapor which is generated on the downstream side of the wall means is immediately disposed in the suction space of the jet pump so that large-volume lines and pressure drops will substantially be avoided and a compact structure can be obtained.

The mass flow rate obtained in case of a given capacity of the jet pump and the temperature of the generated vapor can be adjusted by means of a selection of the consistency and the thickness of the wall means, i.e., a selection of their throttling action. The lowest possible suction pressure and the lowest vapor temperature will be obtained in case of a certain throttling action. A further increase of the throttling action beyond that optimum value would merely decrease the mass flow rate and this is not desired, as a rule. On the other hand, a lower throttling action will result in a higher mass flow rate and in a higher temperature of the generated vapor and this may be desirable under certain operating conditions.

In order to ensure that an evaporation on a large evaporating surface will be effected inside the porous material of the wall means, at least the downstream surface layers of the porous material of the wall means must be permeable to condensate although the wall means must not be completely permeable to condensate. If downstream surface layers of the wall means have a consistency which makes them permeable to condensate, it may be ensured that the suction space will receive only saturated vapor, which has contributed to the refrigerating performance. For this reason the wall means may consist of a plurality of layers of porous materials differing in consistency or, if desired, may consist of a plurality of individual walls, which are spaced apart and may vary in consistency over their thickness or relative to each other. The space between adjacent wall can desirably be used, for instance, for a withdrawal of non-evaporated condensate where a circulatory cooling is employed.

It is already known from German patent publication No. 15 01 591 to pass a liquid through porous material of a heat exchanger and to subject said liquid to a heat exchange with another liquid, which is conducted in liquidtightly separated chambers in the porous material. But that concept does not involve a phase transition of the liquid as it flows through the porous material and the throttling action resulting from the flow through the porous material is inherently undesirable and should be minimized. Besides, no reference has been made to use in the power input section of a refrigerating system and such known heat exchanger could not be used for that purpose.

It is also known from U.S. Pat. No. 4,352,392 to supply a liquid fluid to porous material consisting of sintered metal so that said fluid enters the material and is evaporated there. But in that case the sintered metal constitutes a coating on a surface which is to be cooled and which is effectively cooled by the generation of vapor, which escapes on the side on which the liquid enters the sintered metal. In that case too there is no reference to the power input section of a refrigerating system and the known cooling means could not be used for that purpose.

In accordance with claim 1, the energy required for evaporation can desirably be provided via a heat-conductive connection between the wall means and a heat source. If in accordance with claim 1 the heat source consists of a fluid, such as air, which surrounds the jet pump in an enclosed space, heat can directly be extracted from that enclosed space. For this reason such an embodiment will be particularly suitable as an integrated power input and evaporator section for refrigerated rooms, such as refrigerators or freezing cabinets, and the wall means may simply be arranged inside the refrigerated room. In accordance with claim 10 the heat transfer between the surrounding fluid and the porous material can be improved in that the wall means are sheathed and fins are provided for increasing the heat exchange surfaces. In accordance with claim 11 the sheath may consist to special advantage of an extrusion which has been cut to length. Even if the sheath tightly encloses the wall means and the generated vapor is sucked on that side of the porous material which is opposite to the sheath the condensate can easily be introduced if, in accordance with claim 12, the condensate is supplied to that region of the porous material which is covered by the sheath through suitable passages provided in the sheath and/or the porous material.

Instead of or in addition to the provision of a heat-conductive connection to a heat source, the heat source may be constituted by a heat transfer fluid which is conducted in a metallic pipe coil and is connected to the wall means by surface contact or by being entirely of partly embedded therein. In case of a heat-conductive connection to a heat source by means of a close-fitting sheath, such pipe coil may also be embedded in the porous material of the wall, on principle, in order to effect a utilization of the heat of a heat transfer fluid. But such pipe coil is desirably accommodated in an entrance chamber which is sealed from the environment and disposed on that surface of the wall means which is opposite to the exit of the vapor from the porous material and, if desired, the pipe coil may have some convolutions which are spaced from that surface and that entrance chamber may contain also the condensate so that heat can be transferred from the pipe coil to the condensate before the latter enters the upstream surface of the wall means. In that case a pre-evaporation may be effected, if desired, and condensate in the form of wet vapor can be supplied to the wall means.

If the wall means consist of a plurality of individual walls it will be particularly desirable to provide the pipe coil in a corresponding number of planes in the spaces between such walls and to cause the heat transfer fluid to flow through the pipe coil in such a manner that heat will be exchanged between the liquid or evaporating condensate and the countercurrently flowing heat transfer fluid, as is recited in claim 13.

Whereas the pipe coil may be arranged, on principle, in corresponding planes in the interior of the porous material, such an arrangement of the pipe coils in the gap between adjacent individual walls will afford the advantage that the manufacture is simplified. In any case the extraction of heat from the heat transfer fluid which is conducted in the pipe coil of such an arrangement and which may consist of the fluid that is to be cooled can be effected at low temperature differences, i.e., under most favorable exergetic conditions, and under simultaneously prevailing, optimum heat transfer conditions. If the wall means are divided into individual walls separated ba y gap, fresh additional condensate can be supplied between the walls, particularly between downstream walls, so that moisture content can be maintained in the fluid which enters the individual walls. That moisture content should be about 70% and such an arrangement can be adopted whether or nor the gap contains a pipe coil.

If the process is conducted as has been explained, the entire condensate can be transformed into saturated vapor. But the evaporation can selectively be effected in a circulatory process, particularly if a heat source that is heat-conductively connected to the wall means is not available or should not be utilized of if the heat quantity required for a complete evaporation is not supplied by means of an additional heat transfer fluid. The condensate itself may be used as the only heat source and in that case the large surface of the porous material will act like a trickling-flow evaporator. In that case the heat required to evaporate part of the condensate is extracted from the condensate itself so that non-evaporated condensate at a correspondingly low temperature is left. In accordance with claim 2 that non-evaporated condensate can be returned to the circulatory system by means of a liquid drain through an external heat exchanger, in which a fluid is cooled.

In a particularly preferred embodiment of the invention, the wall means peripherally enclose the suction space of the jet pump and, in particular, are approximately concentric to the center line of the jet pump. In case of such basically sleevelike wall means, the latter will be flown through substantially radially from the outside to the inside and in the wall means may be designed to enclose the suction space with a small diameter and may be disposed as closely as possible to the coldest point of the refrigerating system so that the so-called "dead volume" is also minimized.

In a particularly preferred embodiment of the invention a plurality of jet pumps can be connected in series and the mixed vapor from a preceding jet pump may be used in the next following jet pump as a motive fluid - series connection - or as suction vapor - cascade arrangement - (claims 3 and 4). If more than two jet pumps are connected in series, they may be connected partly in series and partly in cascade.

The series connection recited in claim 3 permits an optimum utilization of the momentum of the motive fluid, as is known per se for vacuum technology from WO No. 80 02 863. In that case the nozzles of the series-connected jet pumps are so matched to each other that the momentum of the motive fluid will be utilized as fully as possible. In that manner the pressure of the mixed vapor from a jet pump can be utilized further in a succeeding jet pump without a detrimental reaction on the function of the delivering jet pump although the temperature and pressure drop in the succeeding jet pump will not be as large as in the preceding jet pump in that case. In case of such a series connection, a single stream of a motive fluid can be used to operate a plurality of jet pumps with progressively decreasing pressure drops so that individual cooling circuits at different cooling temperatures can be connected to respective jet pumps or a plurality of jet pumps which are series-connected in that manner can be incorporated in a single cooling circuit and the warm cooling fluid is first supplied to the last jet pump and is at a correspondingly lower temperature as it leaves the first jet pump of the series. In that case the countercurrent operation that has been explained hereinbefore in connection with claim 13 is applied to a plurality of series-connected jet pumps and that operation may also be applied to each individual jet pump, of course, so that the overall heat exchange will be effected in an almost ideal countercurrent operation.

In case of a cascade arrangement as recited in claim 4, the entire momentum of the motive fluid will be applied to each jet pump which is connected in that manner so that the jet pumps connected in cascade can produce a temperature difference which is much larger than the temperature difference which can be achieved in one stage between the suction space and the mixed vapor exit. This is due to the fact that the mixed vapor pressure increases in the jet pump circuit so that a high mixed vapor pressure permitting a condensation at a high temperature is obtained at the outlet of the multistage circuit. In that case a cooling to low temperatures, e.g., of −10° C., can be effected, in case of need, even if a condensation must be effected at a high temperature, e.g., of 40° C., for instance, in a hot environment.

In such a cascade arrangement a cooling fluid may also be countercurrently conducted from jet pump to jet pump and, if desired, in each jet pump, in the manner that has been described hereinbefore.

Owing to its mode of operation described hereinbefore, such a cascade arrangement can be used with excellent results in a heat pump.

In accordance with claim 6, a particularly preferred improvement of the cascade arrangement which has been explained resides in that a separate cooling fluid is associated with each jet pump or with each defined group of jet pumps, which may be interconnected in series or in cascade, and the separate cooling circuits thus obtained may be connected virtually in series in the cascade arrangement of the jet pumps in that a heat exchange is effected between the evaporator of a succeeding jet pump and the condenser of the preceding jet pump. If such different cooling fluids are selected in such a manner that the cooling fluid for a preceding jet pump has under the mixed vapor pressure of said preceding jet pump a condensation temperature which is at least very slightly higher than the evaporation temperature of the cooling fluid for the succeeding jet pump at the suction pressure of the latter, a heat exchange involving a dual phase transition can be effected adjacent to the evaporator of the succeeding jet pump in that at least part of the heat required for the evaporation of the refrigerant to be evaporated is extracted by said refrigerant from the refrigerant to be condensed so that the latter refrigerant is condensed. In such an arrangement the two different refrigerants in the separate cooling circuits may be used for different cooling functions on different temperature levels.

Claim 9 defines a refrigerating system or a heat pump in which a compressor consists of a jet pump having a plurality N of series-connected nozzles, which are associated with N−1 series-connected jet pump stages. In such an arrangement the mixed vapor from a preceding jet pump stage is used as motive vapor in the next succeeding jet pump stage. Different from the operating characteristics of single-stage jet pumps, in which the optimum ratio of the entrained gas rate to the motive gas rate is obtained only at the design point of the jet pump, the jet pump comprising a plurality of series-connected jet pump stages has a design range in which the optimum ratio of the entrained gas rate to the motive gas rate will be substantially improved as the suction pressure increases and/or as the condensation pressure decreases. The nozzle spacing, nozzle lengths and the entrance and exit areas of the nozzles may be selected to obtain such a nozzle configuration that the ratio of the entrained gas rate to the motive gas that can be optimized for a desired design range rather than only for a design point. Because the arrangement of the several jet pump stages of such multiple ejector is equivalent to the connection of individual jet pumps that has been explained in connection with claim 3, the illustrative connections explained in that context for refrigerating systems and heat pumps can be correspondingly adopted.

In accordance with claim 16, the nozzles of the several jet pump stages desirably have a divergent flow passage at the exit end of the nozzle so that the momentum of the mixed vapor is converted into a pressure rise.

It is pointed out that the multiple ejector arrangement defined in claims 9 and 16 can desirably be combined with the embodiments of the invention defined in the remaining claims.

Claim 1 recites a jet pump and in its prior art part recites a jet pump as disclosed in Published German application No. 29 37 438. Liquid is supplied to the suction space of that known jet pump in such a manner that the liquid surface is subjected to the suction pressure which is generated. As a result, part of the liquid evaporates from its surface and the resulting vapor is supplied to the jet of liquid motive fluid so that the vapor is condensed and the mixed liquid is then withdrawn. In order to assist the evaporation of the liquid in the suction space, the suction space is surrounded by a substantially cylindrical peripheral wall, which consists of porous material and is permeable to the gas and impermeable to the liquid. Owing to the suction pressure in the suction space, gas is sucked through the gas-permeable porous wall and causes the liquid to foam so that the evaporation surface is increased. In that case the porous wall does not act as an evaporator but reduces the efficiency of the jet pump because additional air is sucked through the porous wall.

But the characterizing features of claim 1 have the result that such jet pump can be used in a refrigerating system or heat pump in accordance with the invention and the porous wall acts as throttling means and as an evaporator for the condensate. Whereas such jet pump is particularly suitable for a refrigerating system in accordance with the invention, it can be used to advantage also independently of such system, e.g., as a filter, if the porous wall is used to remove particles, such as oil particles, from the entrained stream. Because the pressure conditions and particularly temperature conditions occurring in the operation of the jet pump can be calculated and predicted, it can also be used as a fractionating filter for removing, e.g., only those fluid fractions which are present as a fluid or as a solid under the resulting thermodynamic conditions whereas other substances, e.g., gases or fluids, will be passed through.

In the latter use it will also be desirable to use a porous material consisting of an effectively heat-conducting metallic material, particularly of a sintered metal.

Further details, features and advantages of the invention are apparent from the following description of embodiments with reference to the drawing.

BRIEF DESCRIPTION OF THE DRAWINGS

FIG. 1 is a diagram illustrating the principle of a refrigerating circuit in accordance with the present invention. An evaporator 2 made of porous material is integrated in a jet pump 1, which is operated by motive vapor delivered by the vapor generator 4. The mixed vapor formed in the jet pump is condensed in the condenser 3 and part of the resulting condensate is returned to the evaporator 2. The other part of that condensate is pumped by the liquid pump 5 back to the motive fluid generator 4. The driving energy $Q_{ex}$ is supplied to the vapor generator 4. The heat of condensation $Q_c$ is extracted from the condensator, and the heat $Q_o$ required to evaporate the refrigerant is supplied to the evaporator 2. The liquid refrigerant enters the evaporator 2 made of porous material and on the large internal surface of the porous material is transformed to a gas. At the same time, the liquid refrigerant is throttled from the condenser pressure $P_c$ to the pressure $P_o$ prevailing in the suction space of the jet pump. The heat $Q_o$ required to evaporate the refrigerant can be transferred to the porous material by heat conduction or in a special embodiment can directly be extracted from the liquid refrigerant.

It must be borne in mind that the temperature which can be obtained in the capillary evaporator may be much lower than the temperature which corresponds to the pressure $P_o$ in the suction space of the jet pump. That pressure drop in capillary systems has already been noticed in absorption processes. See Handbuch der Kältetechnik by Rudolf Planck, Volume 7, Absorptions-Kältemaschinen, by Dr. Ing. Wilhelm Niebergall, page 246, Springer-Verlag, 1959. If the heat exchange is effected on the cold side of the refrigerating system through the sintered metal, such low temperatures can be utilized to produce technical results. As a result, the refrigerant which is employed is cooled substantially below the temperature which would correspond to the pressure conditions in the suction chamber.

Another influence by which the temperature in the capillary system is decreased is believed to consist of a Joule-Thompson effect caused by the exit of the evaporated gas from the capillary system, and presumably of a venturi effect caused in the capillaries by the entrained gas flowing quickly at an angle of 90° C. to the exit of the capillary.

In experiments in which the refrigerant R113 was used and a pressure of 0.462 bar was maintained in the suction chamber, a temperature of 12.5° C. was measured on the surface of the sintered-metal evaporator. That temperature is about 10K below the evaporation temperature corresponding to the above-mentioned pressure in a free environment. In other words, a conventional jet pump would have to produce a suction pressure which is lower by 0.17 bar.

Figure 2:
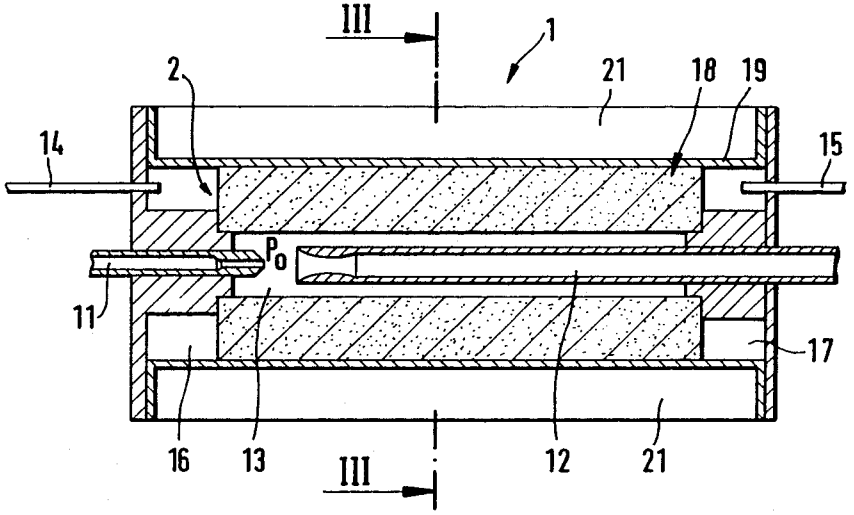
FIG. 2 is a longitudinal sectional view taken on line II—II in FIG. 3 and showing a jet pump in a first embodiment for use in a refrigerating system as shown in FIG. 1.

FIG. 2 is a longitudinal sectional view showing an embodiment of the jet pump 1. Motive fluid, such as vapor, is injected through a jet nozzle 11 and is collected in a mixing nozzle 12. A suction space 13 is provided between the jet nozzle 11 and the mixing nozzle 12. A suction pressure $P_o$ is produced by the jet of motive fluid in the suction space 13 in known manner.

Condensate is supplied through lines 14 and 15 to receiving chambers 16 and 17, respectively, and is delivered from the latter to the radially outer portion of wall means 18.

Figure 3:
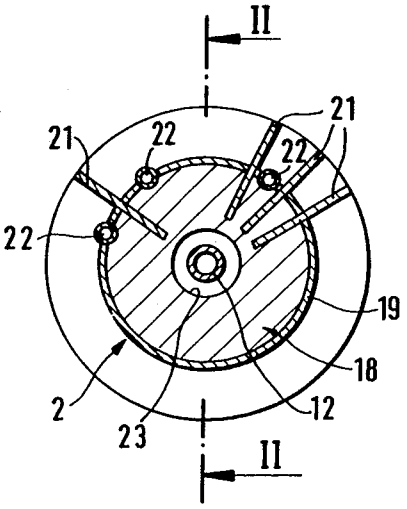
FIG. 3 is a transverse sectional view taken on line III—III in FIG. 2 and showing the jet pump FIG. 2.

As is particularly apparent also from FIG. 3, the wall means 18 are surrounded on the outside by a closely fitting, metallic sheath 19, which has fins 20 projecting into the wall means 18 and fins 21 projecting into the ambient atmosphere. The fins 20 and 21 provide heat exchange surfaces.

For the supply of the condensate to the radially outer portion of the wall means 18, passages 22 are provided between the sheath 19 and the outer portion of the wall means 18. Said passages are provided in that the inside surface of the sheath 19 and the outside peripheral surface of the wall means 18 are correspondingly shaped or recessed. It will be understood that the passages 22 may alternatively be formed only in the sheath 19 or only in the wall means 18 and apertures may be formed in the surface portion of the wall means 18.

The wall means 18 consist of porous material, in the present example of sintered metal, and at least in their surface layers are permeable to the liquid condensate. Condensate supplied through lines 14 and 15 and the receiving spaces 16 and 17 will thus enter a plurality of passages 22, which are distributed around the periphery of the wall means 18, and from said passages will enter the sintered metal of the wall means in a substantially uniform distribution. In such an arrangement the wall means 18 serve as means for throttling the flow of the condensate so that a pressure drop will be obtained across the thickness of the wall means 18 and a pressure that is equal to the suction pressure $P_o$ will be obtained on the downstream surface 23 of the wall means 18. In the manner that has been described in detail in the introductory part, this pressure drop results in an evaporation of the condensate and the resulting vapor exits from the surface 23 and is supplied to the jet of motive fluid.

The thermal energy required for the evaporation is supplied to the porous material by a conduction of heat through the fins 21, the sheath 19 and the fins 20. The resulting extraction of heat from the environment of the fins 21 results in the desired refrigeration.

As is particularly apparent from FIG. 3 the wall means constitute an elongate structure which is uniform in cross-section and comprises outer fins 21 and inner fins 20 so that the sheath can desirably be made available as an extrusion which has been cut to length.

Figure 4:
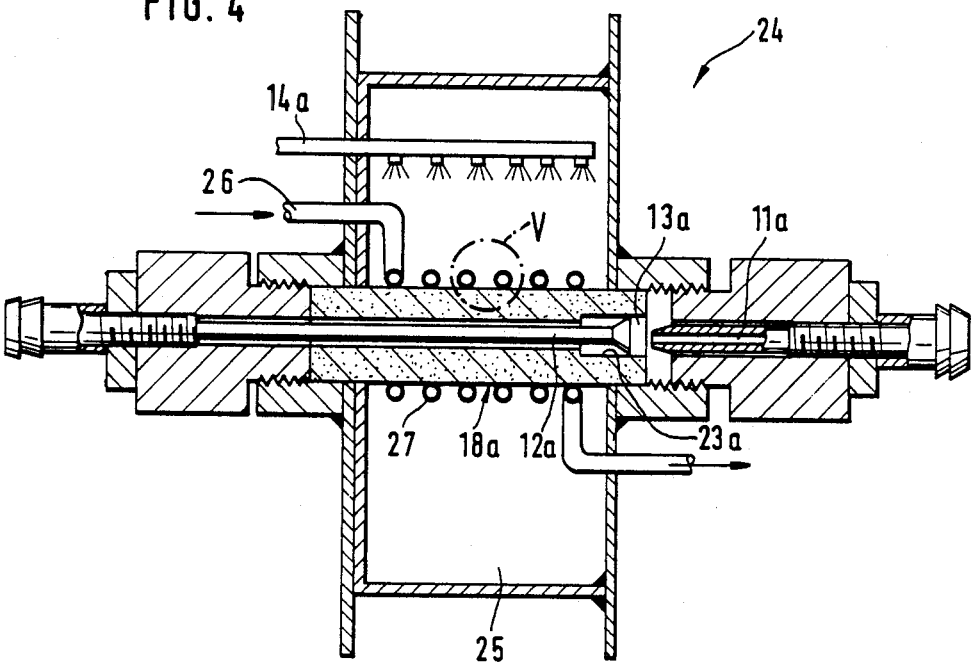
FIG. 4 is a longitudinal sectional view like that of FIG. 2 and shows a different embodiment of jet pump in accordance with the invention.

FIG. 4 shows another embodiment of a jet pump 24 for a refrigerating system in accordance with the invention. The jet pump 24 again comprises a jet nozzle 11*a*, a suction space 13*a* under the pressure $P_o$, and a mixing nozzle 12*a*. Wall means 18*a* made of porous material are also provided. A difference from the embodiment shown in FIGS. 2 and 3 resides in that the wall means 18*a* are not provided on their outside peripheral surface with a close-fitting, heat-conducting sheath but the wall means 18*a* are surrounded by an annular entrance chamber 25 and by said entrance chamber are liquid-tightly sealed from the environment. Condensate is supplied through a line 14*a* to the entrance chamber 25 and from the latter is applied to the outside peripheral surface of the wall means 18*a*. In that embodiment the condensate also enters the condensate-permeable surface portion of the wall means 18*a* and evaporates there and the resulting vapor exits on the downstream surface 23*a* and is supplied to the jet of motive fluid.

Whereas in the embodiment shown in FIGS. 2 and 3 the heat required for the evaporation is extracted from the environment and supplied to the wall means 18 by a conduction of heat, heat is supplied in the embodiment of FIG. 4 by means of a heat transfer fluid in a line 26, which is provided adjacent to the wall means 18*a* as an effectively conducting, metallic pipe coil 27 and closely fits around the outside peripheral surface of the wall means 18*a*. Particularly if metal is used for the wall means 18*a*, a quick equalization of temperature will take place adjacent to the wall means 18*a* so that the extraction of the heat that is used for the evaporation in the interior of the wall means 18*a* will result in a strong cooling also of the outside peripheral surface of the wall means 18*a*. As a result, heat is extracted by a conduction of heat from the heat transfer fluid in the pipe coil 27 so that the heat transfer fluid 7 is cooled correspondingly and can absorb heat at another location for cooling purposes. In that case the source of heat for the evaporation is constituted by the heat transfer fluid which flows in line 26 and which constitutes the cooling fluid.

Figure 5:
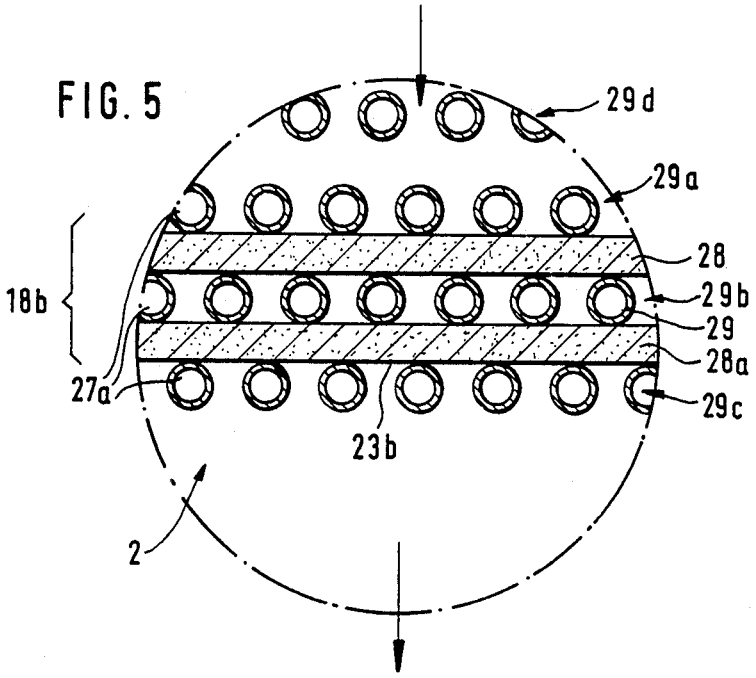
FIG. 5 is an enlarged view showing the detail surrounded by the circle V in FIG. 4 but for a modified embodiment.
Figure 6:
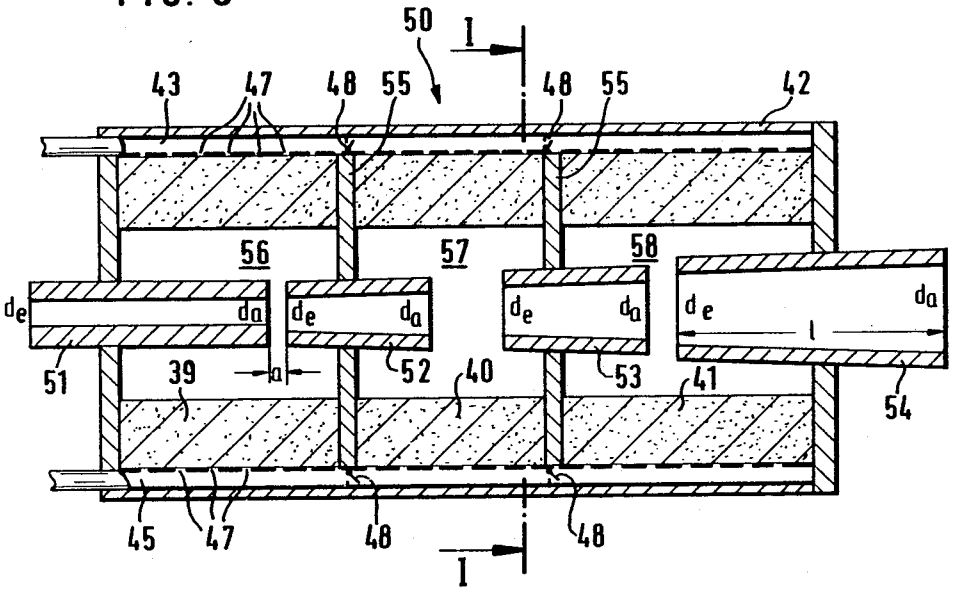
FIG. 6 is a longitudinal sectional view like those of FIGS. 2 and 4 and illustrates another embodiment of a jet pump in accordance with the invention.
Figure 11:
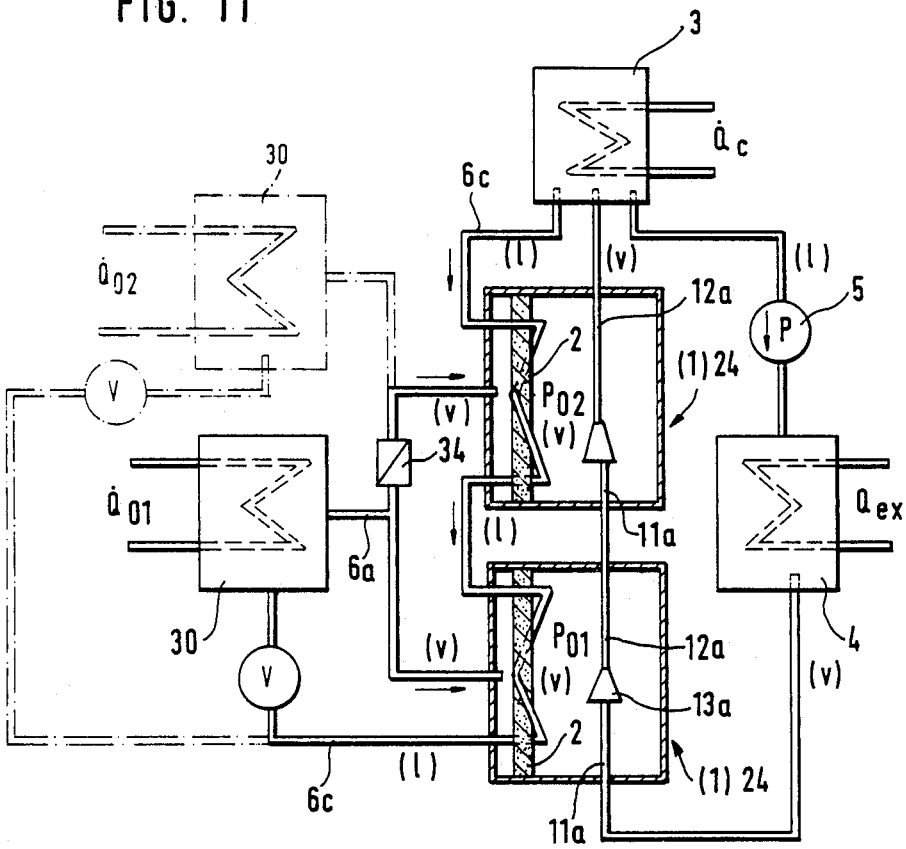
FIG. 11 is a perspective view showing a refrigerating system in accordance with the invention in a further embodiment comprising two jet pumps connected in series.

FIG. 5 illustrates on a larger scale the detail surrounded by the circle V in FIG. 4, but for a modified embodiment. It is apparent from FIG. 5 that wall 18*b* may alternatively consist of a plurality of individual walls, in the present example of two walls 28 and 28*a*. Heat can be transferred to a pipe coil 29 between the two walls 28 and 28*a* and on the outside surfaces of said walls. That pipe coil 29 extends in a plurality of layers or planes 29*a*, 29*b* and 29*c*. The direction of flow through the condensate or the evaporating condensate is indicated by arrows in FIG. 5 to illustrate that the downstream plane 29*a* of the pipe coil contacts the condensate first and may effect a certain pre-evaporation of the condensate. To effect such a pre-evaporation a further plane 29*d* of the pipe coil may be provided in front of and spaced from the wall means 18*b* and said plane 29*d* may serve only to preheat or pre-evaporate the condensate. The evaporation proper is then effected in the first wall 28 of the wall means 18*b* in the manner described hereinbefore and may transform a major part of the condensate to a vapor. A further heat exchange is effected between the evaporating condensate and the second layer of plane 29*b* of the pipe coil 29, which then enters the second wall 28*a*, in which the evaporation must be completed in the present example. If the evaporation has proceeded to such an extent adjacent to the wall 28 that the condensate or the evaporated condensate entering the second wall 28*a* has a very low moisture content, e.g., below 70%, additional condensate for remoistening may be added adjacent to the plane 29*b*. In the present example involving a complete evaporation, saturated steam will be present on the downstream surface 23*b* and just as the adjacent surface of the wall 28*a* will exchange heat with the last plane 29*c* of the pipe coil 29 so that additional heat will be extracted from the heat transfer fluid flowing in said pipe coil and said heat will be extracted at the lowest temperatures which occur. In order to effect a countercurrent heat exchange, which is exergetically favorable, the heat transfer fluid first flows through the plane 29*d* disposed in the region in which the highest temperatures are obtained and exits adjacent to the plane 29*c* in the region in which the lowest temperature is obtained so that the temperature differences are always minimized. FIGS. 6 and 11 are circuit diagrams of various circuits which may be embodied in a refrigerating system which embodies the invention and in which jet pumps of the basic type shown in FIG. 4 (comprising an entrance chamber 25 and involving a heat exchange by means of a heat transfer fluid) are always used, unless a different arrangement is explicitly mentioned. The clearness of the diagrams has been improved by information indicating the phase in which the fluid is present therein. The liquid phase is designated (1) and the gaseous phase is designated (v). In the diagrams the pressures P and the heat fluxes Q or energies are entered with the conventional suffices so that the circuit diagrams are substantially self-explanatory and only aspects requiring special explanation will be discussed hereinafter.

Figure 7:
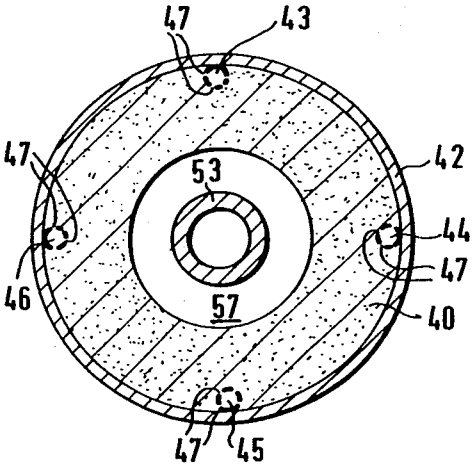
FIG. 7 is a transverse sectional view taken on line I—I in FIG. 6 and shows the jet pump of FIG. 6.

FIGS. 6 and 7 show a further embodiment of a jet pump 30 for use in a refrigerating system or heat pump in accordance with the invention. FIG. 6 is a longitudinal sectional view showing that embodiment of the jet pump 50 and FIG. 7 is a sectional view taken at right angles to the plane designated I—I in FIG. 6. Different from the embodiments of the jet pump shown in FIGS. 2 and 4, the jet pump 50 consists of a plurality of series-connected jet pump stages. Each of the jet pump stages I, II and III consists of four series-connected nozzles 51, 52, 53, 54. Adjacent jet pump stages are gastightly separated from each other by two boundary walls 55. In each jet pump stage, suction spaces 56, 57 and 58 are disposed between adjacent nozzles. The suction spaces 56, 57 and 58 are surrounded by respective wall means 39, 40 and 41 made of porous material and enclosed by an effectively heat-conductive sheath 42, which surrounds the entire jet pump. A plurality of, e.g., four condensate supply passages 43, 44, 45 and 46 are provided in recesses of the wall means 39, 40, 41 and/or the sheath 42 and are used to supply liquid refrigerant, which enters through openings 47 in the condensate passages into the wall means 39, 40 and 41 of the respective jet pump stages.

In order to effect a uniform distribution of the condensate, the condensate supply means might be so designed, e.g., that annular lines surrounding the wall means 39, 40 or 41 of each jet pump stage are connected to the condensate supply passages 43, 44, 45 and 46. Alternatively, the condensate supply passage might helically extend around the wall means of each jet pump stage.

Each of the locations at which the condensate supply passages 43, 44, 45 and 46 extend through the boundary walls 55 is succeeded in the direction of flow of the condensate by a flap trap 48. The heat required to evaporate the condensate is directly supplied from the environment through the effectively heat-conductive sheath 42. The sheath 42 might desirably be provided with fins as in the embodiment shown in FIGS. 2 and 3.

In an alternative embodiment, not shown, the sheath 42 might consist of a double shell through which a heat transfer fluid is conducted which is used to supply the heat required for the evaporation of the condensate and to extract heat for refrigeration. Alternatively, a pipe coil in which a heat transfer fluid is circulated may be wound around the sheath 42.

If motive vapor under a pressure $P_{ex}$ is supplied to the first nozzle 51, a vacuum $P_{o1}$ will be generated in the jet pump stage I so that the condensate supplied to the wall means 39 evaporates and in the second nozzle 52 mixes with the motive vapor from the nozzle 51. The resulting mixed vapor in nozzle 52 is used as a motive vapor in the second jet pump stage II, in the suction space 57 of which condensate from the wall means 40 is evaporated under a slightly higher pressure $P_{o2}$. The mixed vapor thus formed in the third nozzle 33 is used as motive vapor in the third jet pump stage III, in which condensate from the wall means 41 is evaporated under a pressure $P_{o3}$, which exceeds the pressure $P_{o2}$. Mixed vapor under the condenser pressure $P_c$ is finally obtained at the exit of the fourth nozzle 54. It will be understood that four nozzles are provided only by way of example.

In dependence on the increasing suction pressures $P_{o1}$, $P_{o2}$ and $P_{o3}$, the evaporation temperature of the condensate in the respective jet pump stages increases too. If the heat extracted for refrigeration is transferred by a heat transfer fluid, the latter is desirably countercurrently conducted from the third to the first jet pump stage. If the heat transfer fluid is supplied at a temperature below the evaporation temperatures in the jet pump stages II and III or if the temperature of the effectively heat-conductive sheath 42 drops below said temperatures, the pressure conditions which can be achieved in the jet pump will cause the flap traps 48 to close so that condensate is no longer supplied to the jet pump stages II and III. In that case a refrigeration system or heat pump which embodies the invention and which is provided with such jet pump will be automatically controlled in dependence on the conditions on the evaporator side. In the first jet pump stage, the lowest pressure of the vapor to be entrained and the lowest heat flux will be obtained and the evaporation pressure and also the evaporation temperature in the porous wall means 39, 40, 41 as well as the mass flow rate and heat flux in the respective jet pump stage will increase from nozzle to nozzle and from jet pump stage to jet pump stage.

The ratio of the rate of entrained vapor to the rate of motive vapor can be optimized by a calculation of the nozzle entrance diameter $d_e$, the nozzle exit diameter $d_a$, the nozzle lengths 1 and the nozzle spacing a in dependence on the thermodynamic data relating to the desired design range. The nozzle geometry can desirably be matched to the throttling action of the wall means 39, 40 and 41. This will result in a substantial improvement of the refrigerating system or heat pump in accordance with the invention under partial load.

If the temperature and/or pressure gain which is due to the decrease of the evaporation temperature in the capillaries of the sintered-metal evaporator is related to an optimizing of the ratio of entrained gas to motive gas, the improved efficiency multi-ejectors will reduce the motive gas requirement by about 25%. For this reason the combination of the integrated sintered-metal evaporator and of the multi-ejector permits the provision of a vapor jet pump which permits a reduction of the operating costs by about 25% at the final operating point and which provides in a wide temperature range for an automatic control resulting in a ratio of entrained gas to motive gas which increases progressively toward the upper end of the design range. As a result, a refrigerating system or heat pump provided with such multi-ejector has a much higher economy.

It will be understood that the wall means 39 to 41 may alternatively be designed as in the embodiment which is shown in FIG. 5 and all arrangements mentioned in connection with the embodiments of FIG. 4 regarding the conduction of the heat transfer fluid can also be adopted in the embodiment of FIG. 6.

All embodiments of the jet pump explained with reference to FIGS. 2 to 6 might desirably be altered so that the jet nozzle and the mixing nozzle or the plurality of nozzles connected in series are arranged adjacent to the entrance chamber or the sheath and the condensate is centrally supplied adjacent to the suction chamber so that the entrance chamber and the suction chamber are interchanged. In that case the expansion of the resulting vapor to be entrained could be allowed for and a countercurrent operation could be performed.

Figure 1:
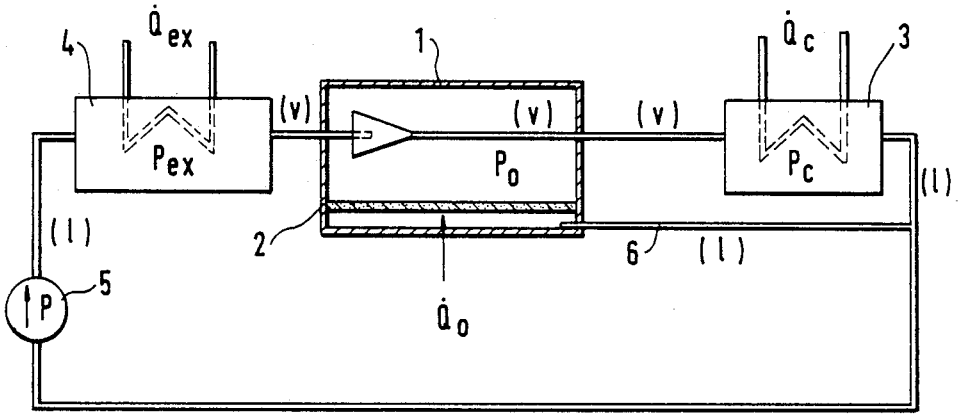
FIG. 1 is a circuit diagram of a refrigerating system or heat pump in accordance with the invention.
Figure 8:
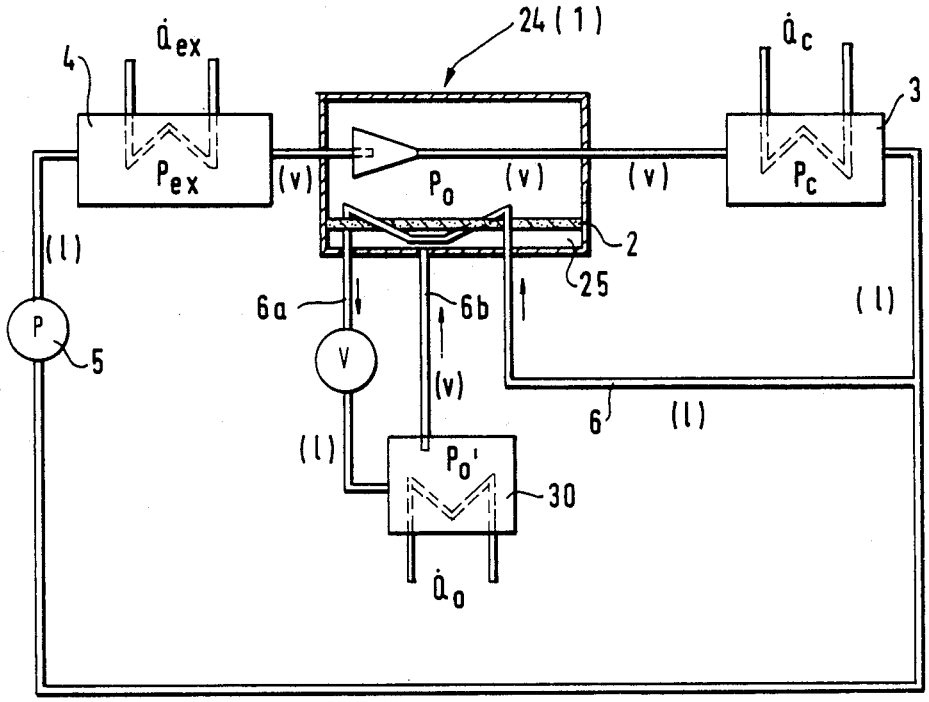
FIG. 8 is a perspective view showing a different embodiment of the refrigerating system in accordance with the invention comprising means for an internal heat exchange.

The embodiment shown in FIG. 8 differs from that of FIG. 1 essentially in that the condensate is not discharged in the entrance chamber 25 by the condensate line 14*a* but is first conducted by the condensate line 6 in non-contacting heat exchange with the evaporator in the same sense as the heat transfer fluid in line 26 and is thus subjected to a preliminary cooling. The still liquid condensate which has thus been precooled is supplied through line 6*a* to a directly evaporating external evaporator 30, which is supplied with heat and in which the condensate is evaporated. The heat rate $Q_c$ required for this purpose corresponds to the useful output of the refrigerating system. The refrigerant vapor is then supplied in line 6*b* to and is discharged in the entrance chamber 25 from the condensate line 14*a* as in FIG. 4. For the operation of the jet pump 24 it makes no difference whether liquid condensate or refrigerant vapor is discharged by the condensate line 14*a* in the entrance chamber 25.

Figure 9:
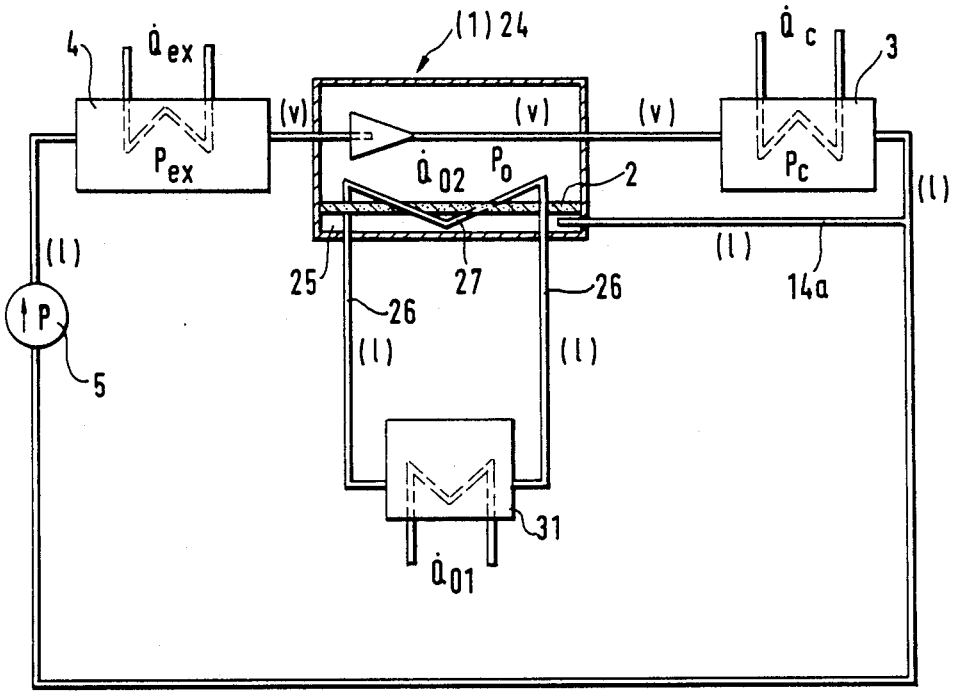
FIG. 9 is a perspective view showing a further embodiment of the refrigerating system in accordance with the invention in a further embodiment in which the fluid to be cooled is in direct heat transfer contact with the porous material.

The embodiment shown in FIG. 9 does not provide for an internal heat exchange such as has been illustrated in and explained with reference to FIG. 8 but the liquid condensate which has been branched off behind the condenser 3 is discharged in the entrance chamber 25 from the condensate line 14*a*, as has been explained with reference to FIG. 4, and is evaporated in the evaporator 2. The heat for evaporation is extracted from the pipe coil 27 and from the liquid heat transfer fluid flowing therein. That fluid extracts said heat in an external heat exchanger 31 from the useful output of the refrigerating system is available.

Figure 10:
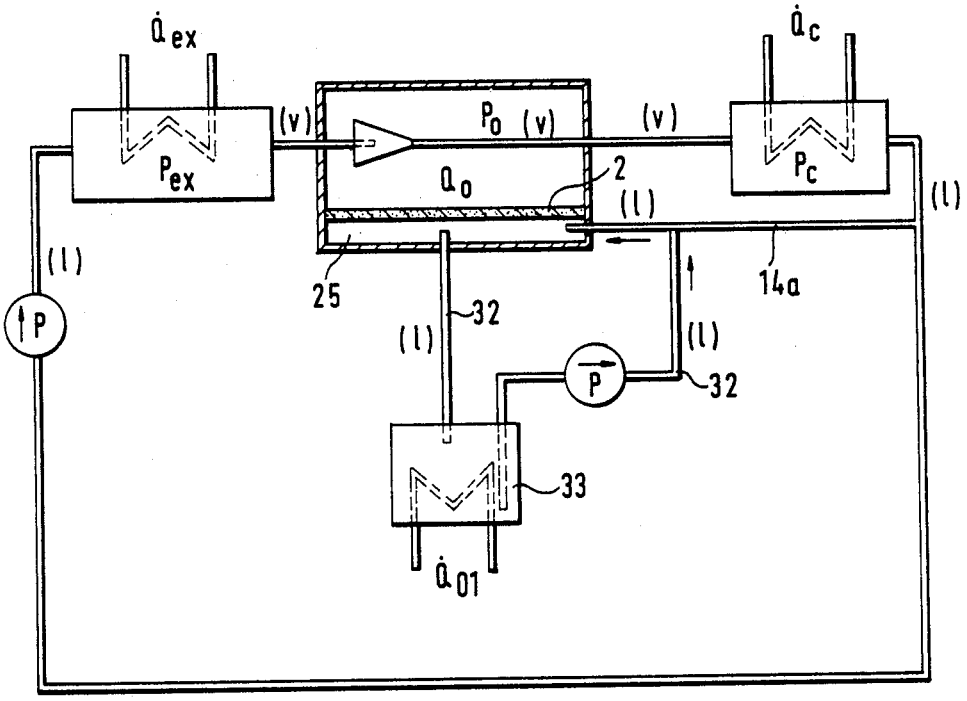
FIG. 10 is a perspective view showing the refrigerating system in accordance with the invention in another embodiment involving a circulatory cooling process.

In the embodiment shown in FIG. 10, liquid condensate is supplied through the condensate line 14*a* into the entrance chamber 25 and is then supplied to the evaporator 2, as has been explained with reference to FIG. 4. In the example shown the evaporator 2 and the wall means 18*a* may not be adapted to receive substantial heat quantities by a conduction of heat or in another manner. In that case the thermal energy required for the evaporation will be available only as the energy content of the condensate. As a result, the initial evaporation will cause heat to be extracted from the condensate and the internal surface of the porous material will act like a trickling-flow evaporator. The condensate which has been transformed to a vapor enters the stream of motive fluid in the manner described and non-evaporated, cooled condensate is left and is withdrawn through a liquid drain 32 from the region of the entrance chamber 25 and of the evaporator 2 and returned to the circulatory system through a heat exchanger 33, as is apparent from FIG. 10. The useful output of the refrigerating system is available at the heat exchanger 33. The condensate which has been heated in the heat exchanger 33 is recycled to the entrance chamber 25. Cooling is thus effected in a circulatory system.

Figure 12:
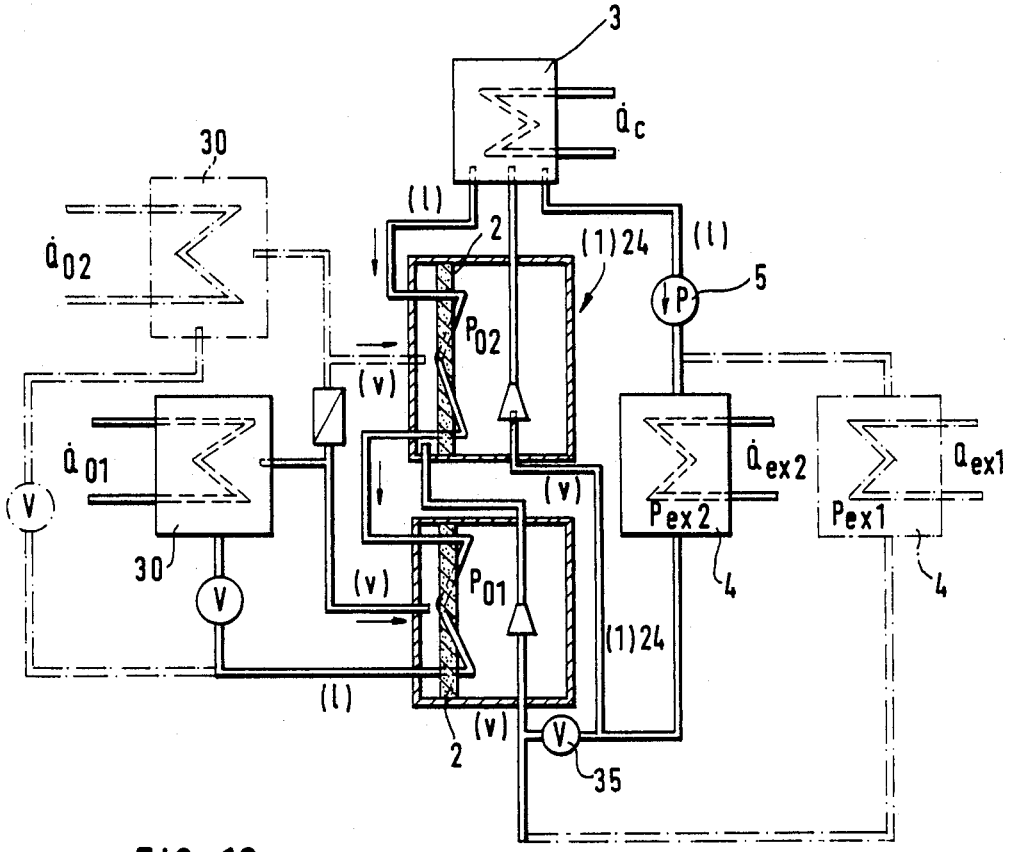
FIG. 12 is a perspective view showing a refrigerating system in accordance with the invention in a further embodiment comprising two jet pumps connected in cascade.
Figure 13:
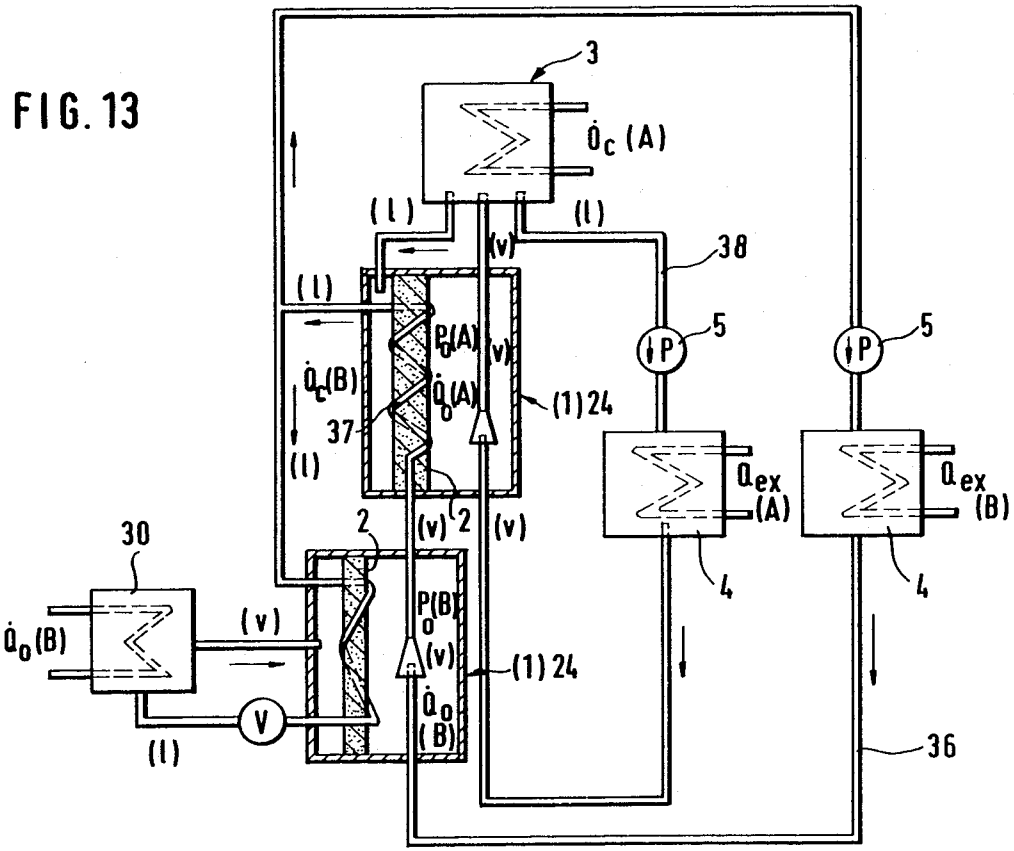
FIG. 13 is a perspective view showing the refrigerating system in accordance with the invention in a still further embodiment comprising two jet pumps connected in cascade and two cooling circuits connected in series.

The circuit diagrams of FIGS. 11 to 13 represent refrigerating systems comprising a plurality of series-connected jet pumps, e.g., two of such pumps. In connection with all evaporators of the jet pumps, a coldside arrangement providing for an internal heat exchange is illustrated. It will be understood that said arrangements may be replaced by any other variant of the mode of heat exchange, e.g., as shown in FIGS. 9 and 10.

The embodiment shown in FIG. 11 comprises a first jet pump 24 including a jet nozzle 11*a*, a suction space 13*a* and a mixing nozzle 12*a*. The exit of the mixing nozzle 12*a* is connected to the jet nozzle 11*a* of the succeeding jet pump 24 so that the mixed vapor from the preceding jet pump is used as a motive fluid in the succeeding jet pump 24. As a result, the pressure at the exit of the mixing nozzle of the first jet pump 24 can be re-used in the succeeding jet pump 24 although the momentum will be lower and the suction pressure $P_{o1}$ in the preceding jet pump 24 will be lower than the suction pressure $P_{o2}$ in the succeeding jet pump 24.

In a circuit like that shown in FIG. 8, a heat transfer fluid will be cooled in both cases. The heat transfer fluid flows in a line 6*c*, which corresponds to one of the lines 6 of FIG. 8, into the region of the evaporator 2 of the succeeding jet pump 14 and then flows through a pipe coil 27 but at the outlet of said pipe coil is not supplied to the heat exchanger 30 but to a corresponding pipe coil 27 of the evaporator 2 of the preceding jet pump and is subjected there to a temperature which is lower than the temperature adjacent to the succeeding jet pump 24 so that heat is extracted. This arrangement results in a countercurrent heat exchange. It will be understood that another countercurrent heat exchange can be performed adjacent to both evaporators 2 of the two jet pumps 24, as has been explained more in detail with reference to FIG. 5.

Liquid heat transfer agent finally flows from the evaporator 2 of the preceding jet pump 24 in line 6*c* into the heat exchanger 30 and is directly evaporated there. The vaporous heat transfer fluid is supplied through a branched line 6*d* and a flap trap 34 to the entrance chambers 25 of the two jet pumps 24.

Saturated vapor is formed by the complete evaporation of the wet vapor, which has been supplied in line 6*a* (or also in line 6*b* in FIG. 8) or has at least been generated adjacent to the pipe coil 27. Additional moisture can be supplied in the form of condensate in order to increase the energy that is extracted by the evaporation, as has been explained in more detail with reference to FIG. 5.

In case of need a second external evaporator 30 may be connected as is indicated by broken lines in FIG. 11 and the arrangement may be such that each evaporator 30 is associated with one of the jet pumps 24 so that there is normally no flow through the flap trap 34.

If the two evaporators 30 are provided and cooperate with respective jet pumps 24, each evaporator will operate in the power range of the associated jet pump 24. If a single evaporator 30 is connected to both jet pumps 24 as has been explained hereinbefore, that evaporator can be controlled throughout the range $P_{o1}$ and $P_{o2}$ while the optimum efficiency of the momentum of the entraining jet is preserved.

In the embodiment shown in FIG. 11 the jet pump 24 is connected in series. In the embodiments shown in FIGS. 12 and 13 a cascade arrangement is provided in which the mixed vapor from the mixing nozzle 12*a* of the preceding pump 24 is supplied to the suction side, i.e., to the entrance chamber 25, of the succeeding jet pump 24. As a result, the mixed vapor pressure obtained at the exit of each mixing nozzle 12*a* will increase in the cascade arrangement from the preceding jet pump 24 to the succeeding jet pump 24 so that the pressure which is obtained at the last mixing nozzle 12a will be much higher than the pressure which could be obtained with only one jet pump in case of a given suction pressure $P_o$ and a given motive fluid pressure $P_{ex}$.

Different from the series arrangement shown in FIG. 11, motive fluid must be supplied to the system at each jet pump 24 so that the live steam which may be used as a motive fluid in the present example may be taken from motive fluid generators 4 operating under different pressures, as is indicated by dash lines in FIG. 12. A connection between the first motive fluid generator 4 and the jet nozzle of the first jet pump 24 is shut off by a diagrammatically illustrated shut-off valve 35. That line will only be required if both jet pumps 24 are supplied from a single motive fluid generator 4 and may be entirely omitted, of course. The jet pump 24 forming the last stage is connected to that motive fluid generator 4 which produces the highest motive fluid pressure so that the back pressure at the associated mixing nozzle 12a will be as high as possible. It is assumed that that motive fluid generators is the motive fluid generator 4 shown in solid lines. The heating fluid exit of the motive fluid generator 4 shown in solid lines may be connected to the heating fluid inlet of the motive fluid generator 4 which is shown in dash lines so that the latter generator 4 will operate under a lower pressure and is connected to the preceding jet pump 24. In other respects, the design on the low-temperature side does not differ from the embodiment shown in FIG. 9, which is referred to for further details.

The embodiment shown in FIG. 13 comprises also a cascade arrangement as shown in FIG. 12 but the two jet pumps are operated with different refrigerants. The first jet pump 24 has associated with it a cooling circuit which is generally designated 36 and in which the conventional condenser 3 has been replaced by a condenser 37, which will be explained in more detail hereinafter. In other respects the cooling circuit 36 operates like that used in the embodiment of FIG. 8. The succeeding jet pump 24 has associated with it a cooling circuit 38, which basically corresponds to the embodiment of FIG. 9. The embodiments shown in FIGS. 8 and 9 may be replaced by a circulatory system as shown in FIG. 10.

A peculiar feature of that embodiment resides in that the condenser 37 exchanges heat with the evaporator 2 of the succeeding jet pump 24 and delivers the heat of condensation to the succeeding evaporator. For this reason, different refrigerants must be used in the cooling circuits 36 and 38 so that the refrigerant in the cooling circuit 36 associated with the preceding jet pump 24 will have at the pressure prevailing at the outlet of the preceding jet pump a condensation temperature which is approximately as high as or higher than the evaporation temperature of the refrigerant in the cooling circuit 38 of the succeeding jet pump 24 at the suction pressure $P_o$ of that pump so that the heat required to evaporate the refrigerant in the circuit 38 can be recovered from the circuit 36 adjacent to the condenser 37.

The jet pump 24 shown in FIG. 4 and having a wall means 18a which consist of sintered metal and concentrically surround the sinter line like a sleeve can be used with excellent results in all arrangements shown for refrigerating systems and heat pumps but has also a significance of its own. For instance, a fluidum other than a refrigerant may be sucked through the sintered metal and the filter action of the sintered metal or another porous wall may be utilized to filter substances from said fluid, as has been explained more in detail in the introductory part.

A special advantage afforded by the refrigerating system of heat pump in accordance with the invention resides in that a highly compact structure is obtained because the evaporator is and/or a plurality of jet pump stages are integrated in a jet pump. Besides, the maintenance is simplified because movable parts other than a liquid pump and flap traps are not required.

I claim:

1. A refrigerating system or heat pump comprising a compressor consisting of a jet pump (1; 24; 30), a condenser (3; 37) succeeding the jet pump and which produces condensate, and an evaporator (2), which communicates with the jet pump and which is adapted to produce an entrainable vapor, which is under low pressure and adapted to be sucked by the motive fluid into the suction space (13; 13a; 36, 37, 38) of the jet pump, wherein the suction space (13; 13a; 36, 37, 38) of the jet pump is preceded by means for throttling the condensate, characterized in that:

the evaporator (2) constitutes at least part of the throttling means and comprises wall means (18; 18a; 39, 40, 41) made of porous material, preferably metallic material, such as particularly sintered metal, for flow of condensate and evaporation condensate therethrough, said wall means having a dwonstream surface and an upstream surface, the downstream surface (23, 23a) of said wall means constitutes at least a part of the boundary surface surrounding the suction space (13; 13a, 36, 37 38) of the jet pump (1; 24; 30) and is liquid-tightly sealed at its lateral edges, and at least those surface layers of said wall means (18; 18a; 18b; 39, 40, 41) which are on the upstream side in the direction of flow of the condensate and initially contacted thereby are permeable to condensate, said wall means (18, 18a; 18b; 39, 40, 41) is heat-conductively connected to a heat source, said heat source being constituted by a metallic heat transfer fluid line, said line being at least partly embedded in said wall means (18; 18a; 18b; 39, 40, 41), and said wall means (18; 18a; 18b; 39, 40, 41) encloses said suction space (13; 13a; 36, 37, 38) of said jet pump (1; 24; 30) at its periphery and is particularly concentrically arranged about the center line of the said pump (1; 24; 30).

2. A refrigerating system according to claim 1 characterized in that a liquid drain (32) opens adjacent to the wall means (18a; 18b) and is adapted to recycle non-evaporated condensate through an external heat exchanger (33) into the circulatory system (FIG. 10).

3. A refrigerating system according to claim 1, characterized in that a plurality of jet pumps (1; 24; 30) are so connected in series that the mixed vapor from a preceding jet pump is used as motive fluid in the next succeeding jet pump (FIG. 11).

4. A refrigerating system according to claim 1, characterized in that a plurality of jet pumps (1; 24; 30) are so connected in series that the mixed vapor from a preceding jet pump is used as entrainable vapor in the next succeeding jet pump (FIGS. 12, 13).

5. A refrigerating system according to claim 3, characterized in that fluid to be cooled is counter-currently conducted through a group of series-connected jet pumps (1; 24; 30) in such a manner that said fluid is first caused to exchange heat with the condensate or evaporating condensate of the last succeeding jet pump (1; 24;

30) of the group and is finally caused to exchange heat with the condensate of evaporating condensate of the first preceding jet pump (1; 24; 30) of the group.

6. A refrigerating system according to claim 4, characterized in that each jet pump (1; 24; 30) is provided with a separate cooling circuit (36; 38) containing an associated refrigerant, said refrigerants differ in that the condensation temperature of the refrigerant of a preceding jet pump (1; 24; 30) under the mixed vapor pressure of said pump is at least very slightly higher than the condensation temperature of the refrigerant in the succeeding jet pump (1; 24; 30) under the suction pressure therein, and the condenser (37) for the refrigerant of the preceding jet pump exchanges heat with the wall means (18*a*, 18*b*) of the succeeding jet pump (1; 24; 30).

7. A refrigerating system according to claim 1, characterized in that said heat transfer line consists of a pipe coil.

8. A refrigerating system according to claim 1, characterized in that the heat source is additionally constituted by a metallic sheath (19; 42) which is heat-conductively connected to the upstream surface of the wall means (18; 39, 40, 41).

9. A refrigerating system or a heat pump according to claim 1, characterized in that the jet pump (1, 24, 30) comprises a plurality N of series connected nozzles (31, 32, 33, 34), which constitute N−1 series-connected jet pump stages, and the mixed vapor from a preceding jet pump stage is used as motive vapor in a succeeding stage.

10. A refrigerating system according to claim 8, characterized in that the sheath (19; 42) is provided with external fins (21) protruding into the fluid and/or with inner fins (20) protruding into the wall means (18; 39, 40, 41).

11. A refrigerating system according to claim 10, characterized in that the fins (20, 21) of the sheath (19; 42) extend in the longitudinal direction of the sheath (19; 42) and the latter consists of an extrusion which has been cut to length and has the same cross-section everywhere.

12. A refrigerating system according to claim 8, characterized in that the condensate is conducted in passages (22; 43, 44, 45, 46) formed in the material of the sheath (19; 42) and/or formed in the material of the wall means (18; 39, 40, 41) in the condensate-permeable surface layers thereof.

13. A refrigerating system according to claim 7, characterized in that the pipe coil (27*a*) is arranged in a plurality of planes (29*a*, 29*b*, 29*c*) on several walls (28, 28*a*) of the wall means and is flown through by the heat transfer fluid from the upstream planes (29*a*, 29*b*) towards the downstream planes (29*b*, 29*c*).

14. A jet pump, particularly for a refrigerating system or heat pump according to any one of claims 10, 12, 13, 2, 3–6, comprising:

a jet nozzle (11) and a mixing nozzle (12) having a suction space (13; 13*a*) therebetween, wall means (18*a*; 18*b*), which are made of porous material and which constitute at least a part of a boundary surface surrounding the suction space (13; 13*a*) and which are about concentric to the center line of the nozzles (11, 12), a sheath on an outside peripheral surface of the wall means (18*a*; 18*b*) liquid-tightly sealing the wall means (18*a*; 18*b*) from the environment, and a metallic heat transfer fluid line being at least partly embedded in said wall means.

15. A jet pump according to claim 14, characterized by a plurality N of series connected nozzles, which consistute N−1 series-connected jet pump stages, and the mixed vapor from a preceding jet pump stage is used as motive vapor in a succeeding stage.

16. A refrigerating system according to claim 9, characterized in that the exit ends of the plurality of nozzles (31, 32, 33, 34) comprise a divergent flow passage.

* * * * *